US011001411B2

(12) United States Patent
Kuhmann et al.

(10) Patent No.: US 11,001,411 B2
(45) Date of Patent: May 11, 2021

(54) PALLET COMPRISING FOLDED WOODEN COMPOSITE

(71) Applicant: AIR BAMBOO INDUSTRIAL GMBH, Eberswalde (DE)

(72) Inventors: Jochen Kuhmann, Berlin (DE); Matthias Albrecht, Berlin (DE); Roman Kujus-Tenekedshijew, Federow (DE)

(73) Assignee: AIR BAMBOO INDUSTRIAL GMBH, Eberswalde (DE)

( * ) Notice: Subject to any disclaimer, the term of this patent is extended or adjusted under 35 U.S.C. 154(b) by 0 days.

(21) Appl. No.: 16/480,330

(22) PCT Filed: Jan. 22, 2018

(86) PCT No.: PCT/EP2018/051402
§ 371 (c)(1),
(2) Date: Jul. 24, 2019

(87) PCT Pub. No.: WO2018/138037
PCT Pub. Date: Aug. 2, 2018

(65) Prior Publication Data

US 2019/0375544 A1 Dec. 12, 2019

(30) Foreign Application Priority Data

Jan. 25, 2017 (EP) ..... 17153143

(51) Int. Cl.
*B65D 19/00* (2006.01)

(52) U.S. Cl.
CPC ..... *B65D 19/0075* (2013.01); *B65D 2519/00029* (2013.01); *B65D 2519/00064* (2013.01);
(Continued)

(58) Field of Classification Search
CPC ..... B65D 2519/00029; B65D 2519/00019; B65D 2519/00054; B65D 2519/00064; B65D 2519/00338; B65D 2519/00273
(Continued)

(56) References Cited

U.S. PATENT DOCUMENTS 2,706,099 A * 4/1955 Whalley ..... B65D 19/0028 108/53.3
2,744,713 A * 5/1956 De Villers ..... A47B 3/12 108/115
(Continued)

FOREIGN PATENT DOCUMENTS

CN 1438955 A 8/2003
CN 204624120 9/2015
(Continued)

*Primary Examiner* — Jose V Chen
(74) *Attorney, Agent, or Firm* — JMB Davis Ben-David

(57) ABSTRACT

The invention relates to a pallet (1) comprising a first plate (10) and a second plate (20), wherein said first plate (10) and said second plate (20) are parallel, and wherein said first plate (10) and said second plate (20) each extend along a length (L) and a width (W) of said pallet (1), and wherein said pallet (1) comprises a height (H) which extends transversely to said length (L) and said width (W), and wherein said pallet (1) comprises at least one supporting element (11) which is integrally formed with said first plate (10) and/or said second plate (20), wherein said at least one supporting element (11) extends between said first plate (10) and said second plate (20) along said height (H).

12 Claims, 9 Drawing Sheets

(52) U.S. Cl.
CPC ..... *B65D 2519/0094* (2013.01); *B65D 2519/00273* (2013.01); *B65D 2519/00293* (2013.01); *B65D 2519/00323* (2013.01); *B65D 2519/00338* (2013.01); *B65D 2519/00562* (2013.01)

(58) Field of Classification Search
USPC ..... 108/51.3, 56.3, 51.11, 56.1
See application file for complete search history.

(56) References Cited

U.S. PATENT DOCUMENTS 2,925,978 A * 2/1960 Marso ..... B65D 19/0028 108/51.3
3,351,028 A * 11/1967 Louis Davidson ..... B65D 19/0026 108/51.3
3,464,370 A * 9/1969 Martin ..... B65D 19/0024 108/51.3
3,976,013 A * 8/1976 Woodford ..... B65D 19/0026 108/56.3
4,759,295 A * 7/1988 Nilsen ..... B65D 19/0016 108/51.3
4,850,284 A * 7/1989 DeGroot ..... B65D 19/0012 108/56.3
4,875,419 A 10/1989 Helton et al.
5,195,440 A * 3/1993 Gottlieb ..... B65D 19/0026 108/51.3
5,230,291 A * 7/1993 Juvik-Woods ..... B65D 19/0012 108/51.3
5,289,781 A * 3/1994 Beckway ..... B65D 19/0012 108/51.3
5,452,667 A * 9/1995 Lim ..... B65D 19/0012 108/51.3
5,503,085 A * 4/1996 Rozek ..... B65D 19/0087 108/51.3
5,520,120 A * 5/1996 Badger ..... B65D 19/0012 108/51.3
5,528,995 A * 6/1996 Lim ..... B65D 19/0012 108/51.3
5,535,668 A * 7/1996 Besaw ..... B65D 19/0012 108/51.3
9,555,924 B2 * 1/2017 Olvey ..... B65D 19/20
2005/0098067 A1 * 5/2005 Sketo ..... B65D 19/0012 108/51.3
2005/0193926 A1 9/2005 Cassidy et al.

FOREIGN PATENT DOCUMENTS

| | | |
|---|---|---|
| DE | 3217573 | 11/1983 |
| DE | 202009003944 | 6/2009 |
| EP | 0741083 | 11/1996 |
| FR | 2087654 | 12/1971 |
| JP | 2000016429 | 1/2000 |
| WO | 9410051 | 5/1994 |

* cited by examiner

PALLET COMPRISING FOLDED WOODEN COMPOSITE

CROSS-REFERENCE TO RELATED APPLICATIONS

This is the U.S. National Stage of International Patent Application No. PCT/EP2018/051599 filed Jan. 23, 2018, which claims priority to European Patent Application No. 17152932.4 filed Jan. 24, 2017, and International Patent Application No. PCT/EP2017/069954 filed Aug. 7, 2017.

The invention relates to a pallet comprising folded wood material, particularly wood veneer. In particular the pallet can be used for storage and/or transport of goods.

Different types of pallets are known from the prior art.

So-called Euro pallets (i.e. described in DE 20 2009 003 944 U1) are cheap and easy to produce, but they are relatively heavy and consume a considerable amount of space when stacked for storage or transport.

For example, document DE 32 17 573 A 1 describes a stackable pallet formed from a composite of fibers and an artificial resin in one piece. However, the production of this type of pallet is relatively complex. Stacking pallets from other material, such as paper or plastic are known, but these are either heavy and expensive in production (plastic pallets), or they comprise limited mechanical stability and therefore limited load-bearing capacity (paper pallet).

Therefore, the problem to be solved by the present invention is to provide a pallet which is improved with respect to the above mentioned disadvantages of the prior art, wherein particularly mechanical stability is provided combined with light weight and low complexity of production.

This objective is attained by the subject matter of the claims.

A first aspect of the invention relates to a pallet comprising a first plate and a second plate, wherein the first plate and the second plate are parallel, and wherein the first plate and the second plate each extend along a length and a width of the pallet and wherein the pallet comprises a height which extends transversely to the length and the width, wherein the first plate and/or the second plate comprises at least one supporting element which is integrally formed with the first plate or the second plate, wherein the at least one supporting element extends between the first plate and the second plate along the height.

Therein, the supporting elements are not separate parts, but are formed from the same piece of material as the first plate or second plate. However, the first and the second plate are separate parts, such that each respective supporting element is integrally formed from either the first plate or the second plate, but not from both the first plate and the second plate.

In certain embodiments the first plate comprises the at least one supporting element.

In certain embodiments the second plate comprises the at least one supporting element.

In certain embodiments, the first plate and the second plate comprise the at least one supporting element. That is, the first plate may comprise respective supporting elements integrally formed from the first plate, and the second plate may comprise respective supporting elements integrally formed from the second plate.

For example, the supporting elements can be formed by folding pieces of the first plate and/or the second plate in the direction of the height, that is perpendicular to the first and second plate. This may be achieved by introducing mitres into a plate and folding parts of the plate along the mitres.

The supporting elements form a mechanically stable and stiff core of the pallet.

Advantageously, the pallet according to the invention can be easily manufactured in a time-efficient and cost-efficient manner, because the supporting elements are not formed from separate parts but are integrally formed with the first plate and/or second plate.

Supporting elements on both the first and the second plate provide additional stability to the pallet.

In certain embodiments, the first plate and/or the second plate are formed from a wood material, particularly a high density fiber board.

Advantageously wood materials, such as for example high density fiberboards comprise an especially high material strength combined with a relatively low weight, are easily available and cheap.

In the context of the present specification, the term wood material designates a material which comprises shredded wood, particularly wood chips, wood veneer, wood veneer strips, wood wool, wood fibres, wood dust or other lignocellulose materials. Furthermore, the wood material may contain binding agents, adhesives, and/or additives. In particular, additives may be hydrophobization agents, wood preservatives, flame retardants, hardeners, or paint particles. In particular, binding agents may include urea-based glue, synthetic resins, i.e. phenolic resins, isocyanates, plastics and/or bioplastics. In particular, wood veneer and/or wood veneer strips serve for manufacturing of plywood and/or oriented strand boards (OSB).

In particular, wood materials include solid wood materials, i.e. solid wood boards (according to DIN EN 12775) or glued wood materials, laminated timber, block boards, and/or laminated wood, veneer wood materials, i.e. veneer plywood, laminated veneer lumber, parallel strand lumber, bending plywood, pressed wood, i.e. flat pressed boards (P2), particle boards, chip board molded parts, oriented strand boards (OSB, according to DIN EN 300) and/or laminated strand lumber (LSL), wood fiber materials, i.e. wood fiber insulation boards (HFD), porous fiberboards, soft boards (SB), medium density fiberboards (MB), hardboards (HB or HFH), extra-hard fiberboards (HFE), medium density fiberboards (MDF), high density fiberboards (HDF), and/or ultralight fiberboards, Arboform or liquid wood.

Therein, the term fiberboards designates the wood materials specified in DIN EN 622. The term particle boards designates the wood materials specified in the standards DIN EN 309 and DIN EN 312. The term plywood designates the wood materials specified in the standards DIN 68708 and DIN EN 313.

Wood materials have the advantages of a high material strength and mechanical load-bearing capacity combined with a light weight.

In certain embodiments, the wood material comprises a lignin content of >5%, particularly >10% weight proportion. That means that in particular paper and cardboard are not considered wood materials within the scope of the present invention, since during paper production, the lignin of the used wood raw materials is removed for example by chemical bleaching agents.

In certain embodiments, the wood material is free from chemical bleaching agents.

In certain embodiments, the wood material is manufactured in a dry process at a wood moisture content of <20%. Therein the percentage refers to the ratio of the weight of the water contained in the wood material to the absolute dry wood mass. In a dry process, the wood particles are dried before formation of a fleece and pressing into the final product, and the final product comprises a wood moisture content of less than 20%. Glue can be applied before or after drying.

In certain embodiments, the wood material comprises wood fibers which are pressed by application of pressure and/or heat. In certain embodiments, the wood material comprises a density of >800 kg/m$^3$. For example, high density fiberboards comprise densities in this range.

In certain embodiments, the first plate and the second plate are mechanically connected by means of the at least one supporting element.

In certain embodiments, the first plate comprises at least one first opening, wherein the at least one supporting element is positioned adjacent to the at least one first opening, particularly adjacent to a partial circumference of the at least one first opening.

Advantageously, the supporting elements can be formed by folding along the edges of the first openings during manufacture of the pallet. In addition, the weight of the pallet is reduced due to the at least one first opening.

In certain embodiments, the first plate and the at least one supporting element are mechanically connected to each other by means of corresponding first mitres, particularly V-shaped first mitres. By means of such mitres, the supporting elements can easily be folded from an intermediate product during manufacture of the pallet. In particular the first plate comprises an adhesive material, particularly a glue, applied at the mitre, wherein the position of the supporting elements is fixed by means of the adhesive material.

In certain embodiments, the second plate comprises at least one fourth opening, wherein the at least one supporting element is positioned adjacent to the at least one fourth opening, wherein particularly said second plate and said at least one supporting element are mechanically connected to each other by means of corresponding third mitres.

In certain embodiments, the pallet comprises at least one first supporting element extending along the length of the pallet and at least one second supporting element extending along the width of the pallet. Therein, the first and second supporting elements can be positioned along first and/or second openings extending along the length or width of the pallet.

This causes an increased stability and stiffness, particularly bending stiffness of the pallet.

In certain embodiments, the at least one supporting element is positioned at a rim of the first plate, wherein the at least one supporting element forms at least a partial frame, particularly a complete frame, around the circumference of the first plate. Advantageously, the core of the pallet between the first and second plate is closed from the outside by means of such a frame, in particular such that dirt is prevented from entering the pallet, and/or such that the frame forms a decorative outer surface of the pallet. In addition, the frame provides additional mechanical stability to the pallet.

In certain embodiments, the at least one supporting element comprises a first strip extending along the height of the pallet and a second strip which is parallel to the first plate and the second plate, wherein the first strip is mechanically connected to the first plate or the second plate by means of a respective third mitre, and wherein the second strip is mechanically connected to the first strip by means of a further respective mitre.

In particular, the first strip and the second strip form an L-shaped profile according to a cross-section of the pallet, wherein one arm of the L-shape is connected to the first plate or second plate.

This embodiment has the advantage that due to the second strip that is parallel to the first plate and second plate, a larger surface is available for connecting, for example gluing the supporting element to the adjacent first or second plate. This further increases the stability of the pallet.

In certain embodiments, the pallet comprises at least one pallet foot, wherein the first plate comprises at least one second opening, and wherein the at least one pallet foot at least partially protrudes through the at least one second opening. By means of the second openings, the pallet feet can be easily and stably attached to the pallet. In addition, the weight of the pallet is reduced by means of the at least one second opening.

In certain embodiments, the second plate comprises at least one third opening, wherein the at least one third opening at least partially overlaps with, particularly is aligned with, the at least one second opening of the first plate. If the second plate contains third openings overlapping with the second openings, two or more pallets can be stacked by inserting the pallet feet of the upper pallet into the third openings of the lower pallet. In addition, the weight of the pallet is reduced by means of the at least one third opening.

In certain embodiments, the at least one pallet foot, more particularly the pallet feet, each comprise/s at least two bearing elements and a base, wherein the at least two bearing elements are mechanically connected to each other by means of the base, and wherein the at least two bearing elements at least partially protrude through the at least one second opening of the first plate. In particular, the bearing elements are formed from boards of a wood material, particularly high density fiberboards.

In certain embodiments, the at least two bearing elements are mechanically connected to respective supporting elements positioned adjacent to the at least one second opening through which the at least two bearing elements at least partially protrude. Advantageously, if the supporting elements are used for attaching the pallet feet, no additional structures for attaching the pallet feet are necessary, reducing the weight and complexity of the pallet. In addition, the same supporting elements can be used to mechanically connect the first and the second plate, and provide mechanical stability to the pallet.

In certain embodiments, the at least two bearing elements comprise a first maximal extension, wherein the first maximal extension is equal to or smaller than a second maximal extension of the at least one second opening in the direction of the length and/or the width of the pallet.

Advantageously, the pallet feet can be inserted into the respective second openings from above or below and are arrested in their final position.

In certain embodiments, the at least two bearing elements and the base are integrally formed by a board, particularly comprising wood material, wherein the board comprises second mitres at the mechanical connections between the at least two bearing elements and the base. Advantageously, the pallet feet can be easily manufactured by folding the board at the mitres.

In certain embodiments, the at least two bearing elements comprise a cross-sectional area delimited by a first edge and a second edge, wherein the at least two bearing elements are mechanically connected to the base by means of the first edge, and wherein the length of the first edge is the minimal extension of the at least two bearing elements in the direction of the first edge, and wherein the length of the second edge is the first maximal extension of the at least two bearing elements in the direction of the first edge.

In certain embodiments, the base extends along a longitudinal axis and has a trapezoid shaped cross-section transversely to the longitudinal axis, wherein particularly the base is formed by a wood material, more particularly a medium density fibre board.

In certain embodiments, the base is formed by a wood material, more particularly a medium density fibre board.

Such bases are mechanically especially stable, which prevents breaking when the pallet rests on the bases of the pallet feet.

A second aspect of the invention refers to a method for manufacturing a pallet, particularly according to the first aspect of the invention, wherein a first plate and a second plate are provided, and wherein at least one first mitre is generated in the first plate, and/or wherein at least one third mitre is generated in the second plate, and wherein at least one supporting element is generated by folding a segment of the first plate at the at least one first mitre, or a segment of the second plate at the at least one third mitre, such that the at least one supporting element extends transversely to the surface of the first plate, and wherein the position of the at least one supporting element is fixed, particularly by gluing, and wherein the second plate is mechanically connected to the first plate by means of the at least one supporting element.

In certain embodiments, at least one first mitre is generated in the first plate, wherein at least one supporting element is generated by folding a segment of the first plate at the at least one first mitre.

In certain embodiments, at least one third mitre is generated in the second plate, wherein at least one supporting element is generated by folding a segment of the second plate at the at least one third mitre.

In certain embodiments, at least one first mitre is generated in the first plate, and at least one third mitre is generated in the second plate, wherein at least one supporting element is generated by folding a segment of the first plate at the at least one first mitre, and wherein at least one supporting element is generated by folding a segment of the second plate at the at least one third mitre.

In certain embodiments, at least one second opening is generated in the first plate, wherein at least one pallet foot is attached to the pallet, wherein the at least one pallet foot at least partially protrudes through the at least one second opening, and wherein at least one third opening is generated in the second plate, wherein the at least one third opening at least partially overlaps, particularly is aligned with the at least one second opening in the first plate.

The invention is further described with respect to the following figures, which are meant to illustrate the invention, but not limit its scope.

Figure 1:
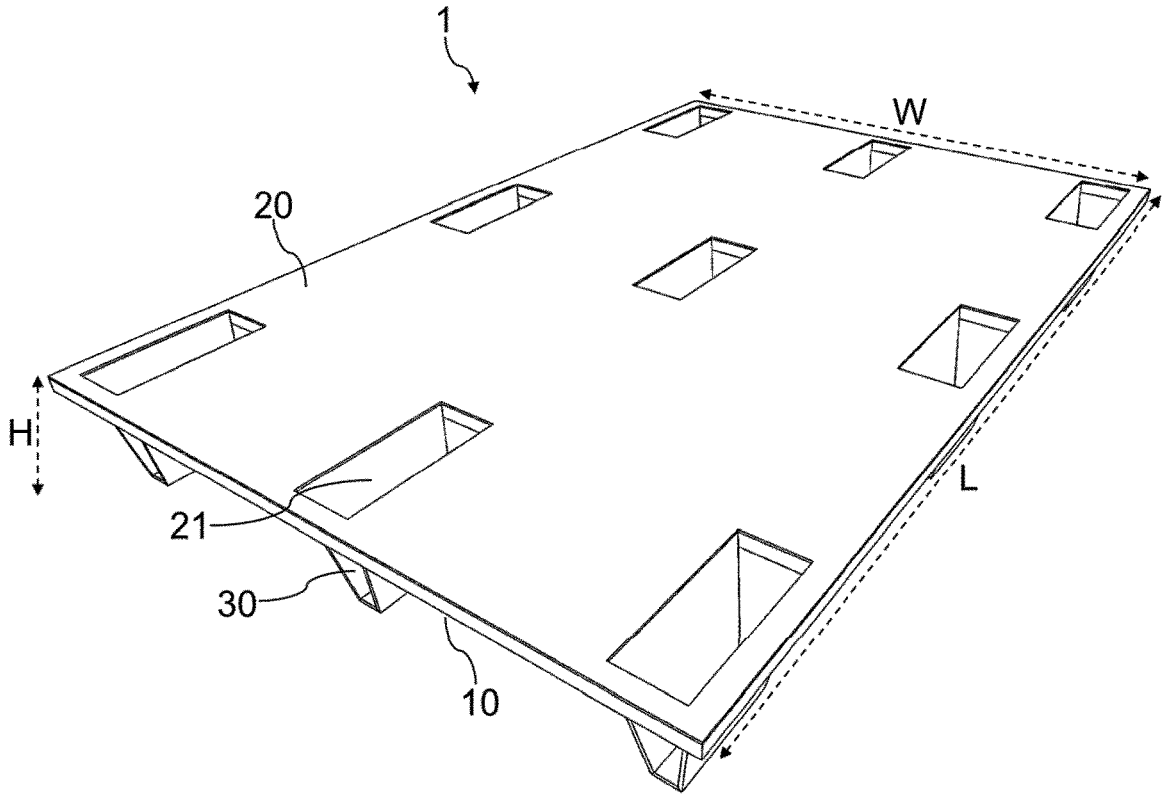
FIG. 1 shows a perspective top view of a pallet according to the invention comprising pallet feet according to a first embodiment.

FIG. 1 shows a perspective top view of a pallet 1 according to the invention comprising pallet feet 30 according to a first embodiment. The pallet 1 comprises a first plate 10 forming the bottom of the pallet body and a second plate 20 forming the top of the pallet body, wherein the first and the second plate 10,20 are parallel to each other and extend along a width W and a length L.

Figure 11:
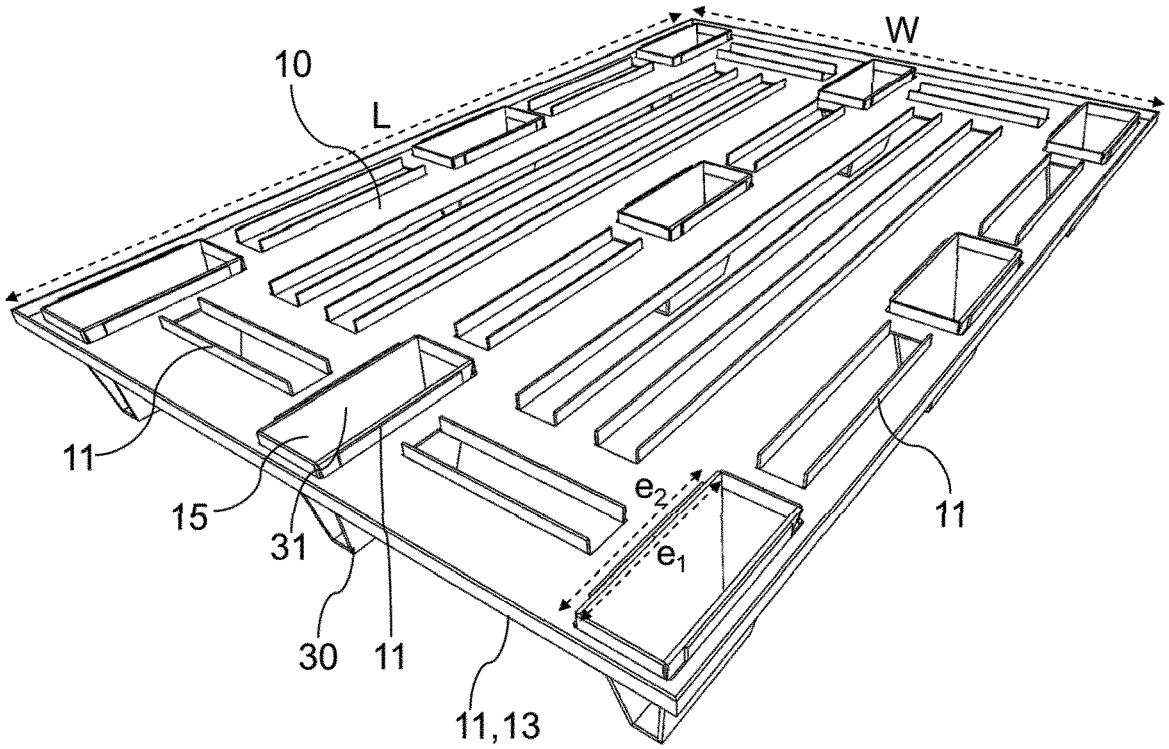
FIG. 11 shows a perspective top view of a first plate of a pallet according to the invention with attached pallet feet according to the first embodiment.
Figure 12:
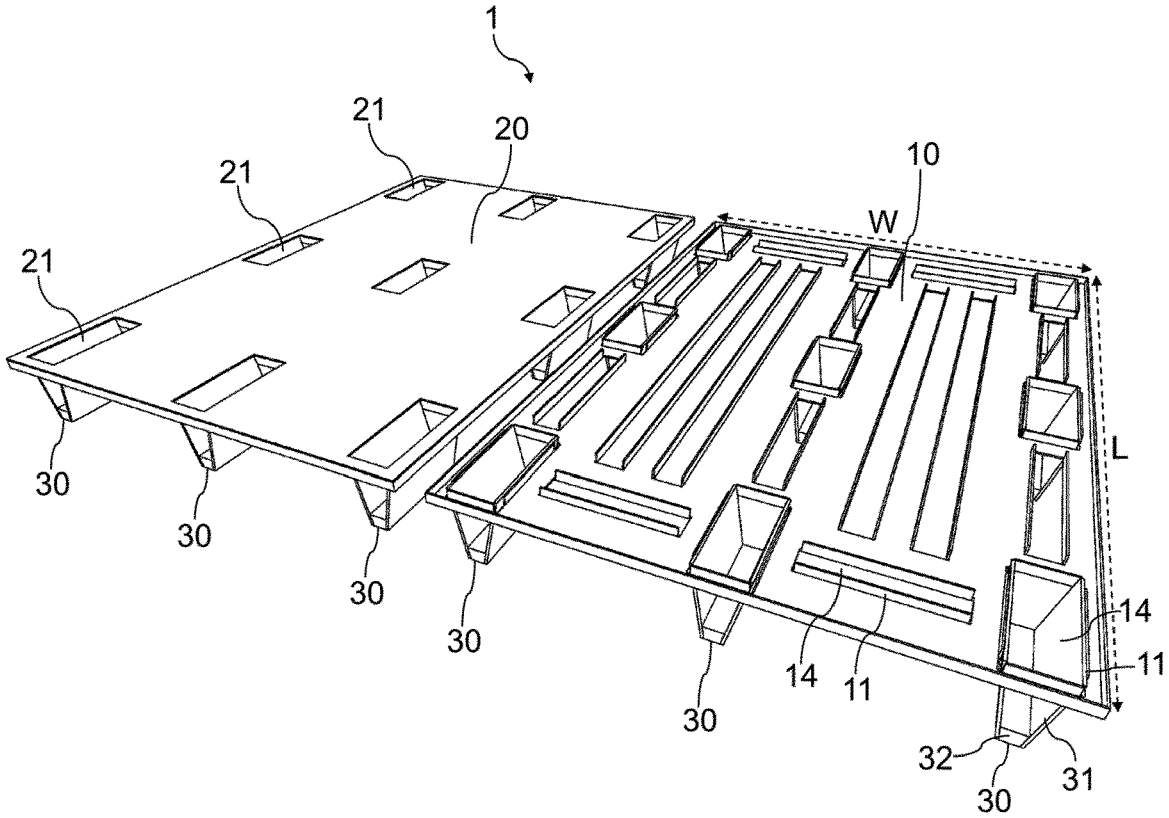
FIG. 12 shows a perspective top view of a pallet and a first plate according to the invention comprising pallet feet according to a second embodiment.

The pallet 1 further comprises pallet feet 30 which are attached to the first plate 10 as shown in detail in FIGS. 11 and 12. The pallet 1 comprises a height H defined by the distance between the first plate 10 and the second plate 20 and the height of the pallet feet 30.

The second plate 20 comprises rectangular third openings 21 extended along the length L and width W of the pallet 1, wherein the third openings 21 are arranged above the pallet feet 30, such that two pallets 1 can be stacked, wherein the pallet feet 30 of the upper pallet 1 of the stack can be inserted into the third openings 21 of the neighboring lower pallet 1 of the stack. In this manner, stacks of two or more pallets 1 can be formed in a space-saving arrangement.

Figure 2:
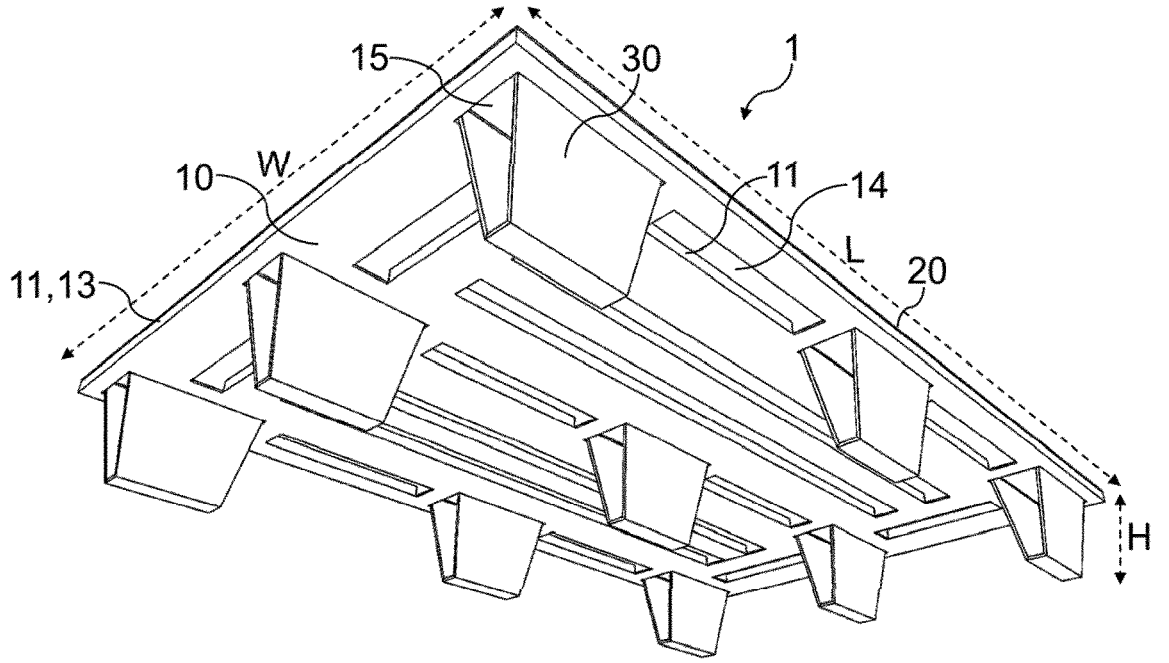
FIG. 2 shows a perspective bottom view of a pallet according to the invention comprising pallet feet according to the first embodiment.

FIG. 2 shows a perspective bottom view of the pallet 1 shown in FIG. 1. The first plate 10 of the pallet 1 comprises rectangular first openings 14 and rectangular second openings 15, wherein the first and second openings 14,15 extend along the length L and width W of the pallet 1. The first plate 10 further comprises supporting elements 11 at the edges of the first openings 14, at the edges of the second openings 15, and along the rim 13 of the first plate 10. The supporting elements 11 are extended along the height H of the pallet 1, that is the orientation of the supporting elements 11 is perpendicular to the plane in which the first plate 10 and the second plate 20 are extended.

The supporting elements 11 positioned along the first openings 14, the second openings 15, and the edges 13 serve as spacers between the first plate 10 and the second plate 20, and the second plate 20 is mechanically connected to the first plate 10 by means of the supporting elements 11. For example, this mechanical connection is established by gluing the supporting elements 11 to the second plate 20.

Advantageously, the supporting elements 11 form a mechanically stable core structure of the pallet 1.

Figure 5:
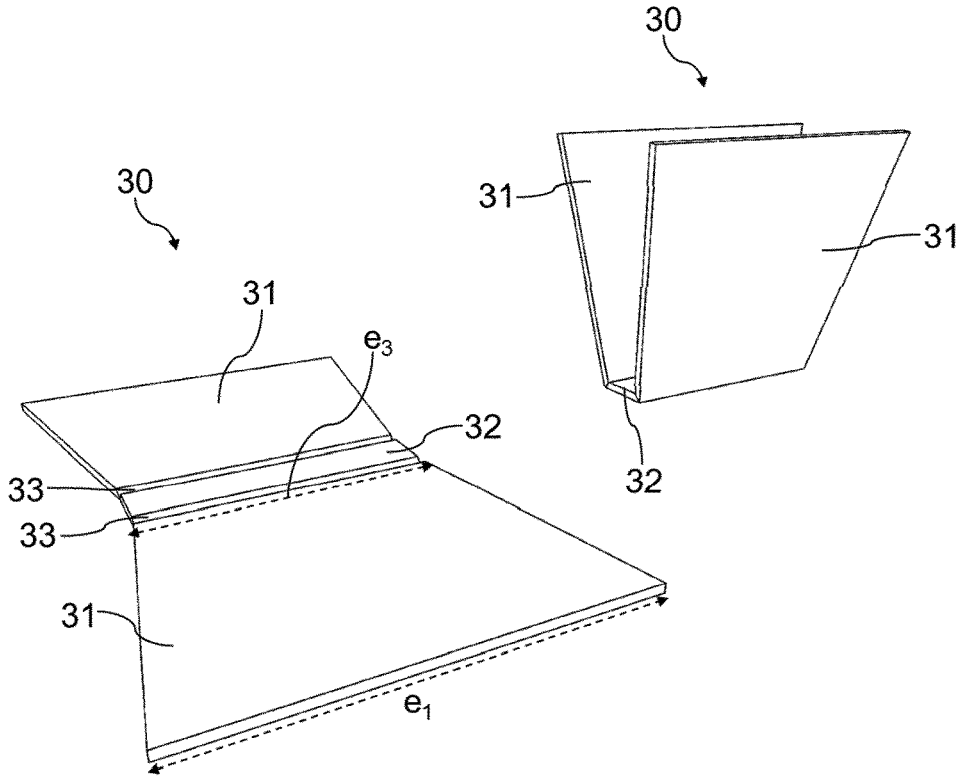
FIG. 5 shows a perspective view of a pallet foot according to a first embodiment.

FIG. 2 further shows pallet feet 30, which are inserted into the second openings 15, and mechanically connected to the supporting elements 11 surrounding the respective second openings 15, as further specified below (see also FIGS. 11 and 12). The pallet feet 30 shown in FIG. 2 are depicted in FIG. 5 and described in detail in the description referring to FIG. 5.

Figure 3:
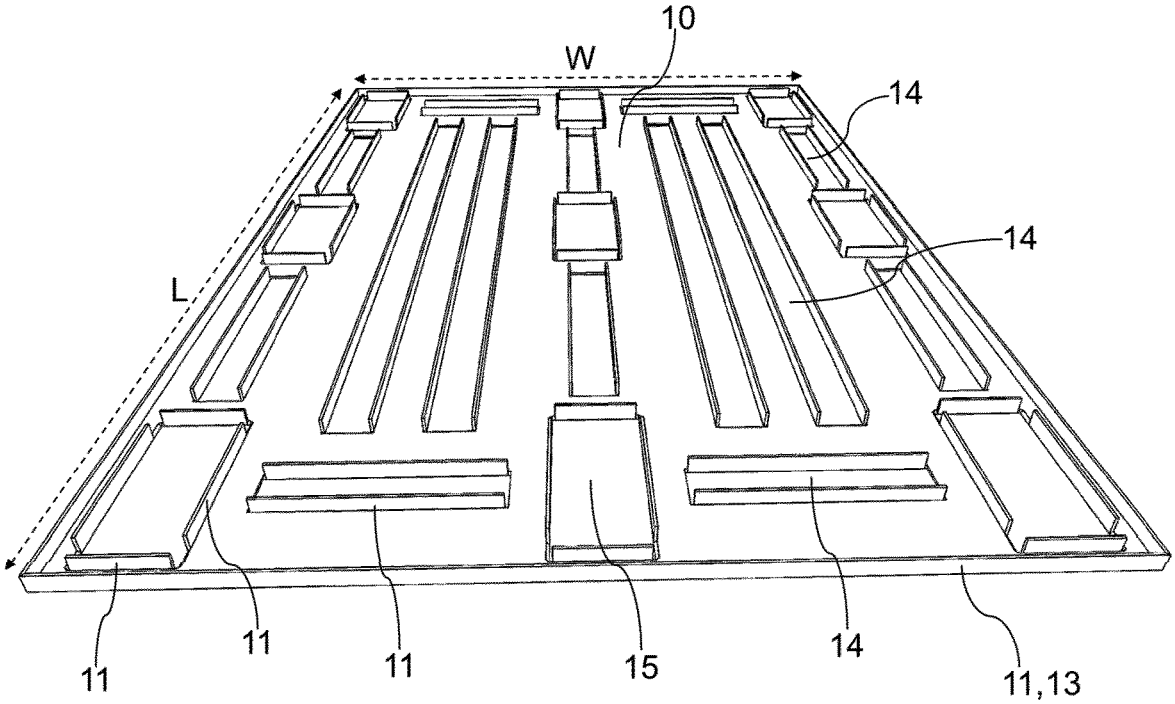
FIG. 3 shows a perspective top view of a first plate of a pallet according to the invention.

FIG. 3 shows a perspective top view of a first plate 10 of a pallet 1 according to the invention. As depicted in FIG. 3, the first plate 10 comprises nine rectangular second openings 15, which are arranged in three rows extending along the length L of the pallet 1, each of the rows comprising three second openings 15, wherein two of the rows are positioned along the rim 13 of the pallet 1, and the third row is positioned along a center line extended in the direction of the length L, Within the rows, the second openings 15 are equally distributed along the length L. Four supporting elements 11 are arranged along the boundaries of the described second openings 15. Therein, two of the supporting elements 11 extend along the whole width W of the second openings 15, and the other two of the supporting elements 11 extend along a section of the length L of the second openings 15, wherein gaps are positioned between the neighboring supporting elements 11 at the corners of the second openings 15.

The first plate 10 further comprises twelve first openings 14, wherein two parallel adjacent first openings 14 extend along the length L of the pallet 1 between the three rows of second openings 15 at either side of the central row of second openings 15. Furthermore, first openings 14 are positioned along the rim 13 of the first plate 10 in the direction of the length L between the second openings 15. Two parallel supporting elements 11 extend along the length L on opposite sides of each of the respective first openings 14.

Moreover, four first openings 14 are extended along the rim 13 of the first plate 10 along the width W of the pallet 1 between the respective second openings 15. Two parallel supporting elements 11 extend along the width W on opposite sides of these respective four first openings 14.

In addition, four supporting elements 11 are positioned at the rim 13 (around the complete rim 13) of the first plate 10. Besides serving as a mechanical connection between the first plate 10 and the second plate 20, these supporting elements 11 form a frame, such that the core of the pallet 1 formed by the supporting elements 11 is closed from the outside in the assembled pallet 1 (see FIGS. 1 and 2).

Figure 4:
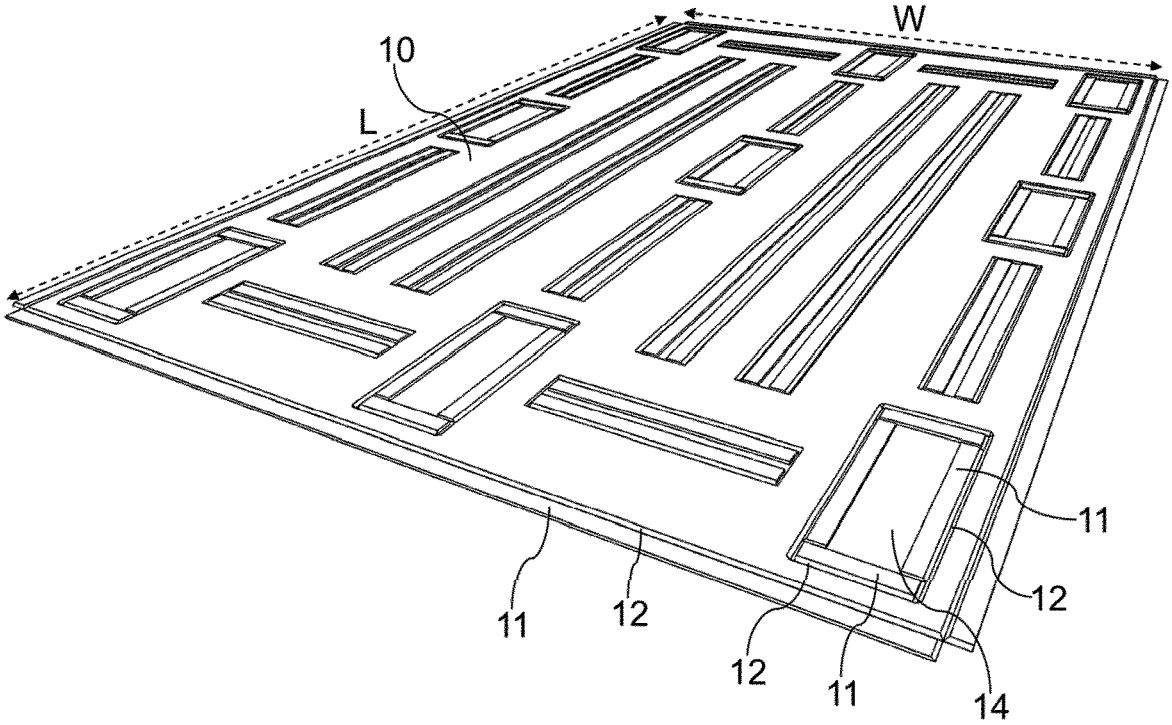
FIG. 4 shows a perspective top view of an intermediate product for forming a first plate of a pallet according to the invention.

FIG. 4 shows a perspective top view of an intermediate product for forming a first plate 10 of a pallet 1 according to the invention. The intermediate product is composed of a plate, for example a high density fiber board, comprising first openings 14, second openings 15, and supporting elements 11, wherein the supporting elements 11 are extended along the plane of the plate, and wherein the supporting elements 11 are connected to the plate at V-shaped first mitres 12.

In order to form the first plate 10 shown in FIG. 3, the supporting elements 11 are folded into the direction of the height H of the pallet 1, that is perpendicular to the plane of the first plate 10. Folding into this direction is possible due to the V-shaped first mitres 12. In particular, glue can be applied to the first mitres 12 prior to folding, such that the supporting elements 11 are fixed in the position shown in FIG. 3 after folding.

FIG. 5 shows a perspective view of a pallet foot 30 according to a first embodiment. The pallet foot 30 comprises two bearing elements 31 from a thin plate, particularly a high density fiber board, having a trapezoid shape, wherein the shorter parallel side of the trapezoid defines a minimal extension $e_3$ of the bearing element 31 and the longer parallel edge of the trapezoid defines a first maximal extension $e_1$ of the bearing element 31. The two bearing elements 31 are mechanically connected to each other by means of a base 32 composed of a rectangular plate, particularly a high density fiber board, at their shorter parallel edges defining the minimal extension $e_3$.

As shown in the left part of FIG. 5, the two bearing elements 31 and the base 32 can be formed by a single plate, particularly a high density fiber board, wherein the bearing elements 31 and the base 32 are separated by second mitres 33, such that the pallet foot 30 can be folded into a position shown in the right part of FIG. 5 at the second mitres 33. In particular, glue can be applied to the second mitres 33 prior to folding, such that the pallet foot 30 is fixed in the position shown in the right part of FIG. 5. Advantageously, the pallet foot 30 can be manufactured in a simple cost-efficient manner by folding i.e. of a high density fiber board.

Figure 6:
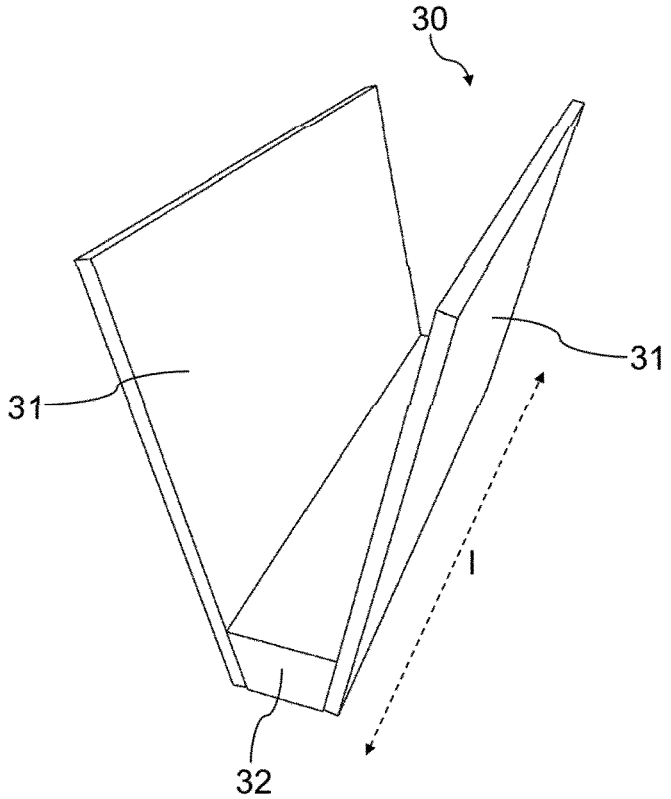
FIG. 6 shows a perspective view of a pallet foot according to the second embodiment.

FIG. 6 shows a perspective top view of a pallet foot 30 according to a second embodiment. The pallet foot 30 comprises bearing elements 31, particularly formed by rectangular boards, wherein the bearing elements 31 are mechanically connected to a base 32. According to the embodiment shown in FIG. 6, the base 32 is formed by a prism shaped block extended along a longitudinal axis l, wherein the base of the prism comprises a trapezoid shape. The shorter parallel edges of the bearing elements 31 are connected to opposite angled surfaces of the base 32, such that the pallet foot 30 is V-shaped in the cross-section of the base 32 with respect to the longitudinal axis l. This embodiment has the advantage that the base 32, on which the pallet 1 rests when the pallet foot 30 is attached to the pallet 1 comprises a high mechanical stability.

Figure 7:
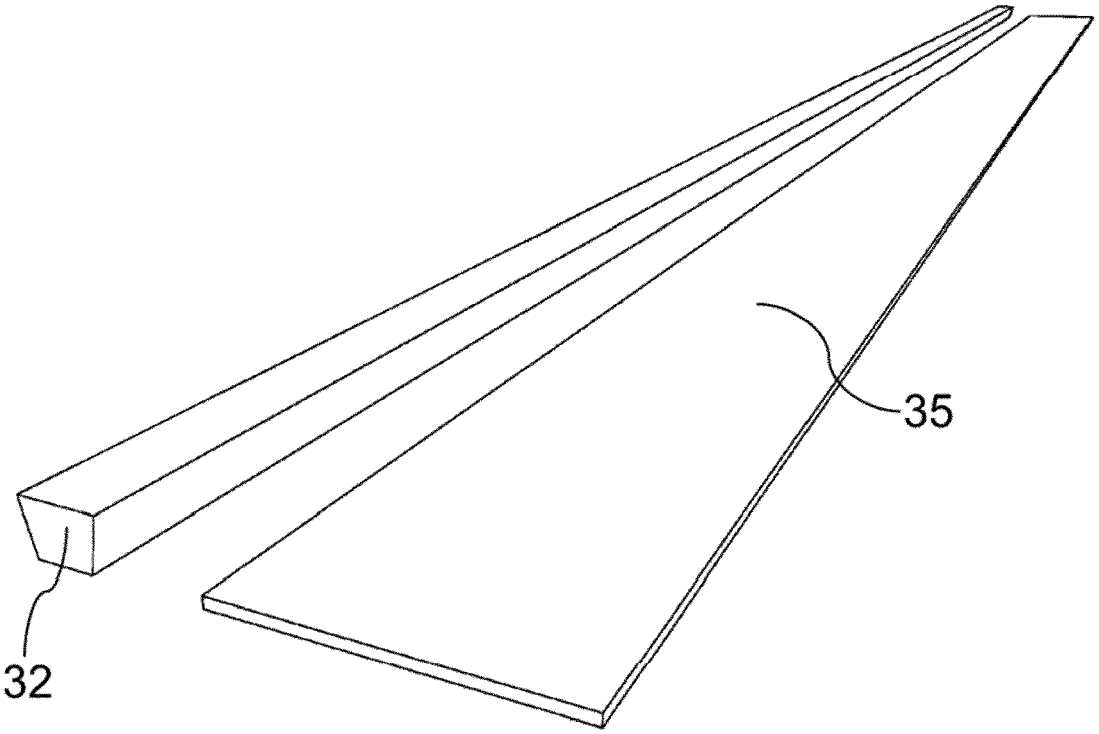
FIG. 7-10 show perspective views of intermediate products for forming a pallet foot according to the second embodiment.

FIG. 7 shows components from which a pallet foot 30, such as the one depicted in FIG. 6, can be manufactured. A long base 32 shaped as a prism with a trapezoid prism base and a board 35, i.e. a high density fiberboard, from which bearing elements 31 can be formed, are depicted.

Figure 8:
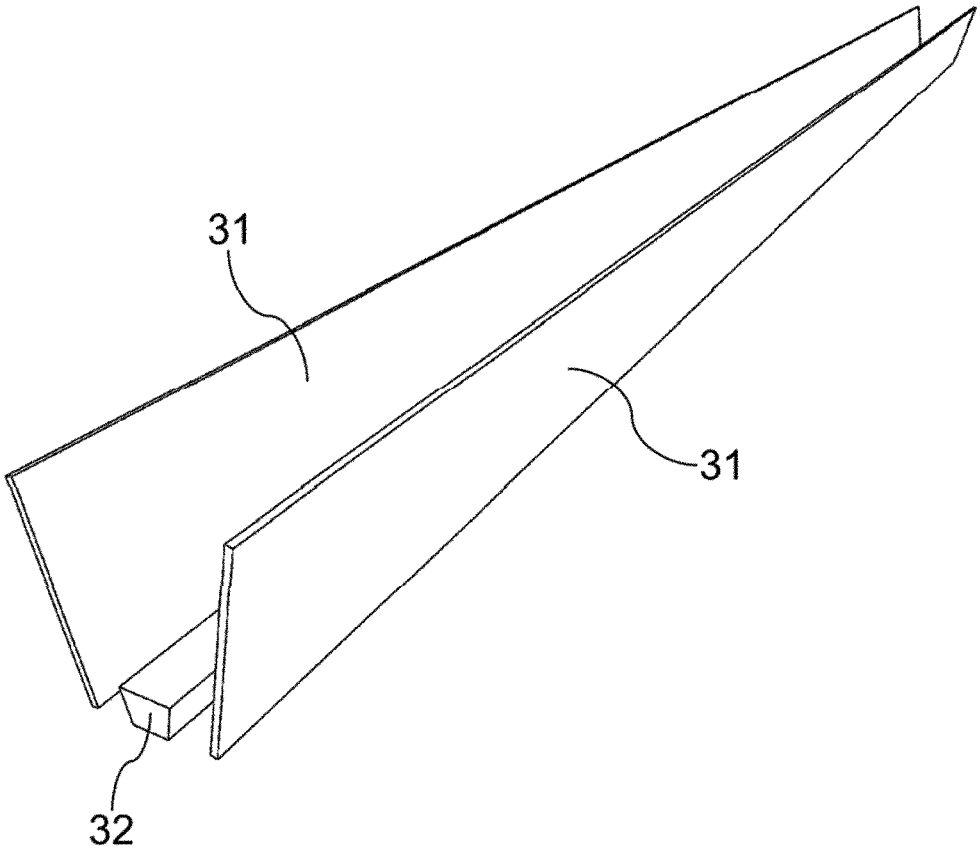

FIG. 8 shows two bearing elements 31 produced by cutting from the board 35 shown in FIG. 7, wherein the bearing elements 31 are arranged on opposite sides of the base 32.

Figure 9:
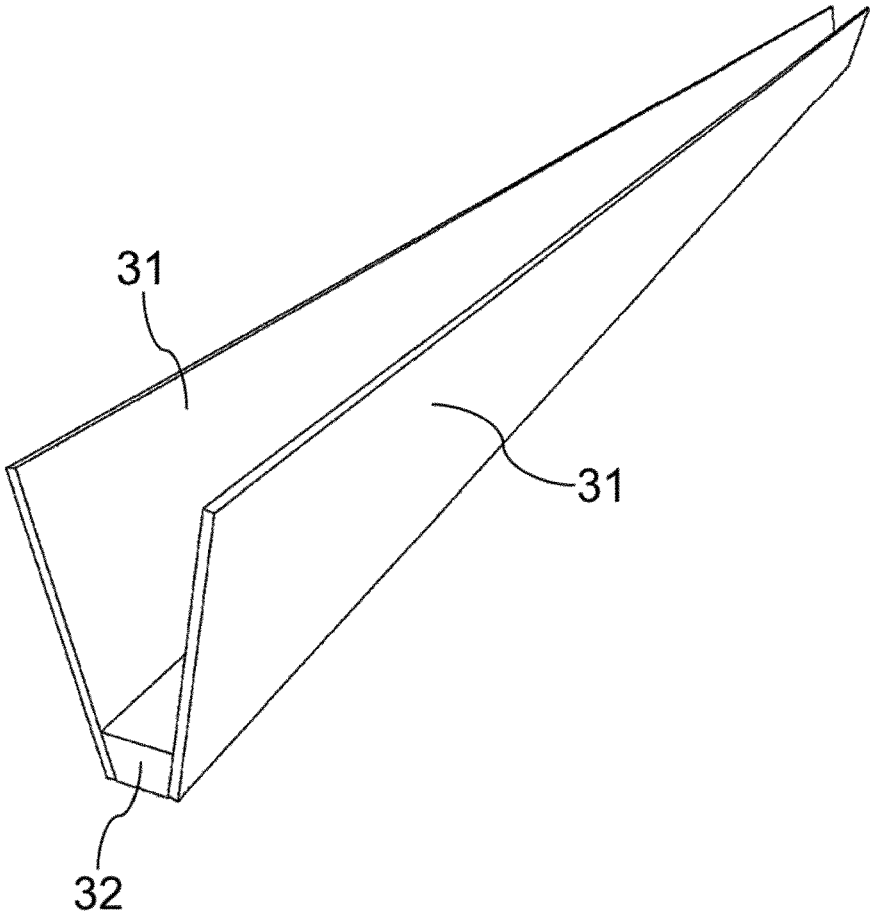

FIG. 9 shows an intermediate product, in which the bearing elements 31 have been mechanically connected, particularly by gluing, to the base 32.

Figure 10:
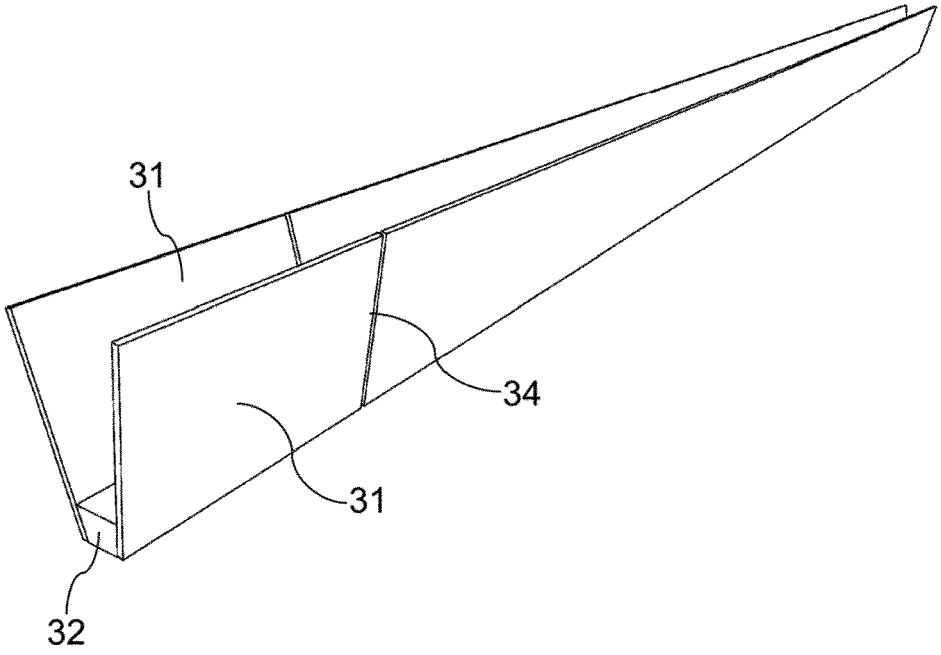

FIG. 10 schematically depicts part of manufacturing process, in which a pallet foot 30 is produced by cutting the intermediate product shown in FIG. 9 at a cutting position 34.

FIG. 11 shows a perspective top view of a first plate 10 of a pallet 1 according to the invention with attached pallet feet 30 according to the first embodiment, such as those depicted in FIG. 5. As shown in FIG. 11, the pallet feet 30 are inserted into the second openings 15 of the first plate 10, wherein the longer parallel edges of the bearing elements 31 defining the first maximal extension $e_1$ (that is the distal edges with respect to the base 32) are mechanically connected to the supporting elements 11 extending along the length L of the pallet 1 around the respective second openings 15, wherein the bearing elements 31 are particularly glued to the respective supporting elements 11.

In this manner the pallet feet 30 are stably attached to the first plate 10, and the overall stability of the pallet 1 is further increased by supporting the core of the pallet 1 between the first plate 10 and the second plate 20.

In particular, the second openings 15, in which the pallet feet 30 are inserted, comprise a second maximal extension $e_2$ along the length L of the pallet 1, wherein the first maximal extension $e_1$ of the bearing elements 31 of the pallet foot 30 is equal to or smaller than the second maximal extension $e_2$ of the second openings 15, such that the pallet feet 30 can be inserted into the respective second openings 15 from above (wherein the base 32 adjacent to the shorter edge of the bearing element 31 defining the minimal extension $e_3$ is inserted first from the above) or below, and are arrested in their final position due to spreading of the bearing elements 31 with respect to the base 32.

FIG. 12 (left part) shows a perspective top view of a pallet 1 comprising pallet feet 30 according to the second embodiment depicted in FIG. 6.

FIG. 12 (right part) shows a perspective top view of a first plate 10 of a pallet 1 according to the invention with pallet feet 30 according to the second embodiment depicted in FIG. 6. Similar to the pallet feet 30 shown in FIG. 11, the distal edges of the bearing elements 31 with respect to the base 32 of the pallet feet 30 are mechanically connected, particularly glued, to the respective supporting elements 11 extended along the second openings 15 in the direction of the length L of the pallet 1.

Figure 13:
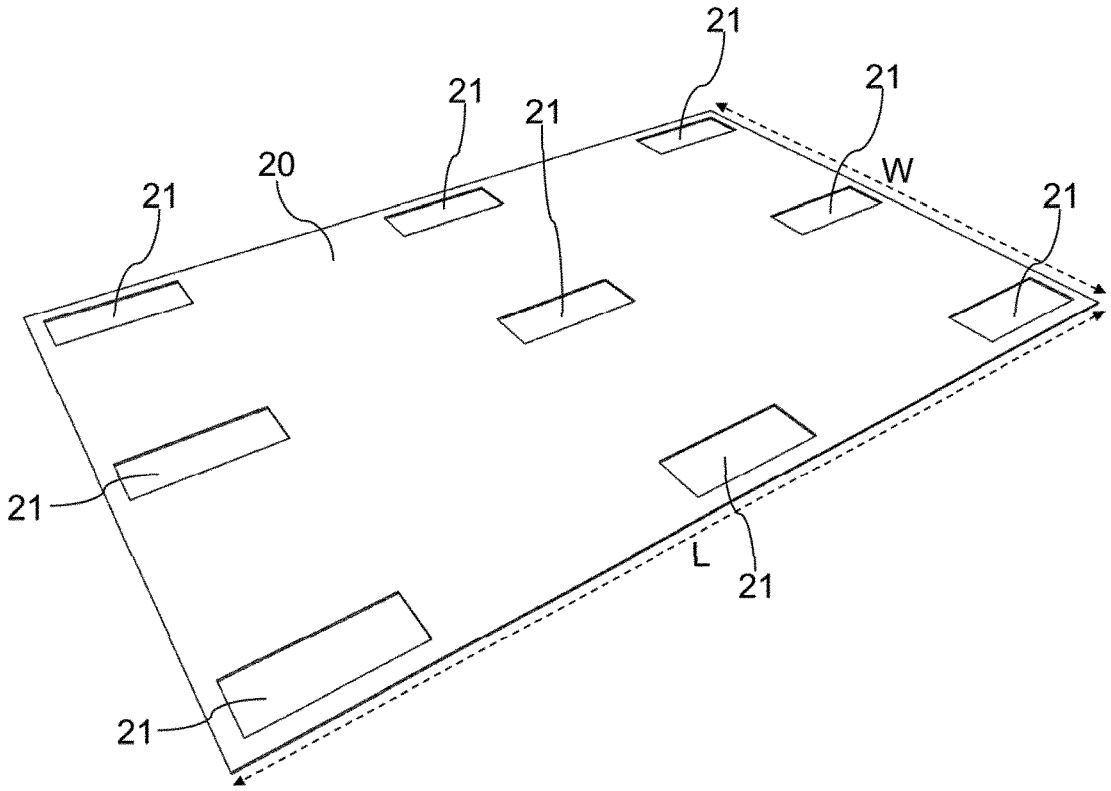
FIG. 13 shows a perspective top view of a second plate of a pallet according to a first embodiment.

FIG. 13 shows a second plate 20 of a pallet 1 according to a first embodiment, wherein the second plate 20 comprises nine rectangular third openings 21, which are aligned with the respective second openings 15 of the first plate 10.

When the second plate 20 is attached to the first plate 10 as shown in FIG. 1 and FIG. 12 (left part), thereby forming the pallet 1, the third openings 21 of the second plate 20 are arranged above the second openings 15, and thus above the pallet feet 30 along the height H of the pallet 1. Therefore, advantageously, two or more pallets 1 according to the invention can be stacked on top of each other, wherein the pallet feet 30 of the upper pallet 1 are insertable into the third openings 21 of the neighboring pallet 1 below. In this manner, a plurality of pallets 1 can be stored or transported taking up a minimum of space.

Figure 14:
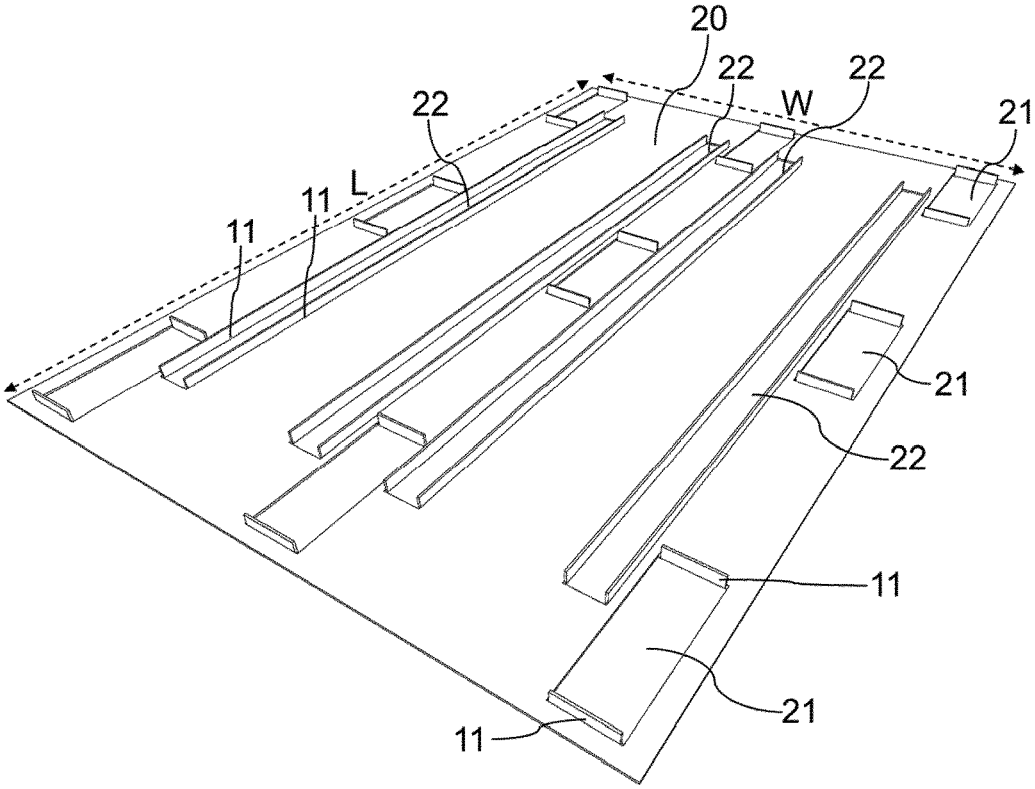
FIG. 14 shows a perspective top view of a second plate according to a second embodiment.

FIG. 14 shows a perspective top view of a second plate 20 according to a second embodiment. The second plate 20 comprises nine rectangular third openings 21, the positions and shapes of which correspond to the those of the third openings 21 of the second plate 20 according to the first embodiment depicted in FIG. 13.

In addition, the second plate 20 depicted in FIG. 14 comprises supporting elements 11 positioned along the two opposite short sides of the third openings 21, wherein the supporting elements 11 extend along the width W of the pallet and along the height H perpendicular to the second plate 20.

Furthermore, the second plate 20 comprises four rectangular fourth openings 22 extending along the length L of the second plate 20. Along the fourth openings 22, additional supporting elements 11, which extend along the length L and height of the pallet 1 (transversely to the first plate 10 and the second plate 20), and which are integrally formed from the second plate 20, are positioned.

Figure 15:
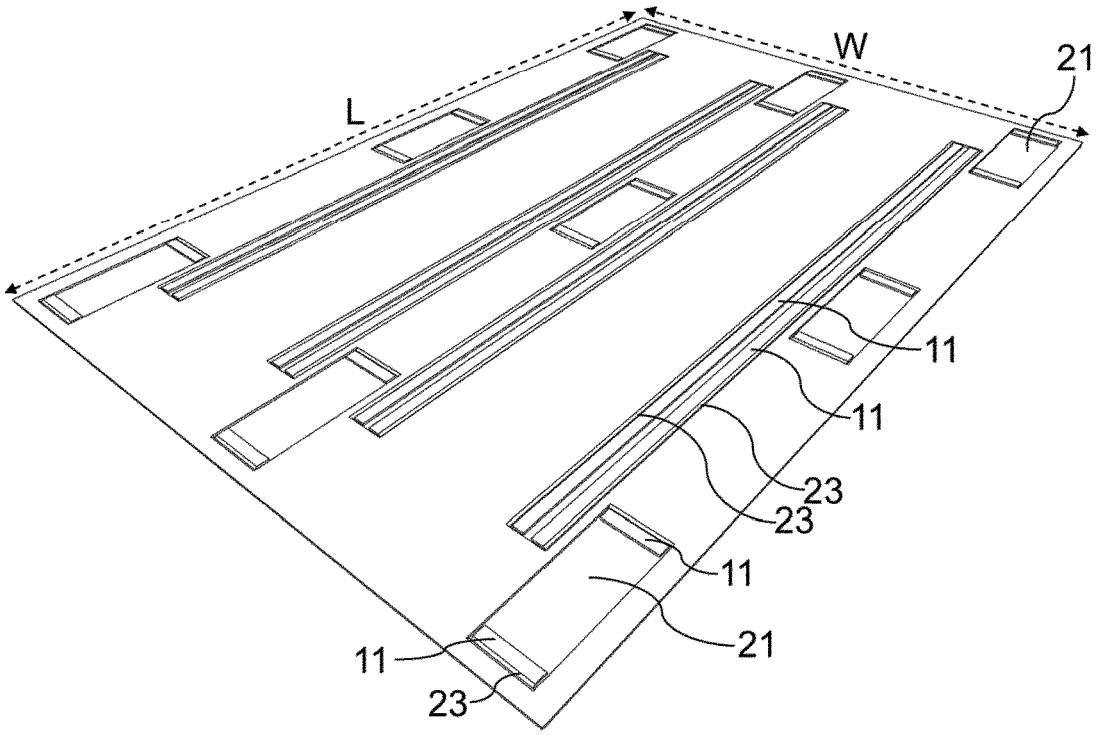
FIG. 15 shows a perspective top view of an intermediate product for forming the second plate according to the second embodiment.

FIG. 15 shows a perspective top view of an intermediate product for forming the second plate 20 according to the second embodiment. The intermediate product is composed of a plate, for example a high density fiber board, comprising third mitres 23, particularly V-shaped third mitres 23, and third openings 21.

In order to form the second plate 20 shown in FIG. 14, the supporting elements 11 are folded into the direction of the height H of the pallet 1, that is perpendicular to the plane of the second plate 20. Folding into this direction is possible due to the V-shaped third mitres 23. In particular, glue can be applied to the third mitres 23 prior to folding, such that the supporting elements 11 are fixed in the position shown in FIG. 14 after folding.

Figure 16:
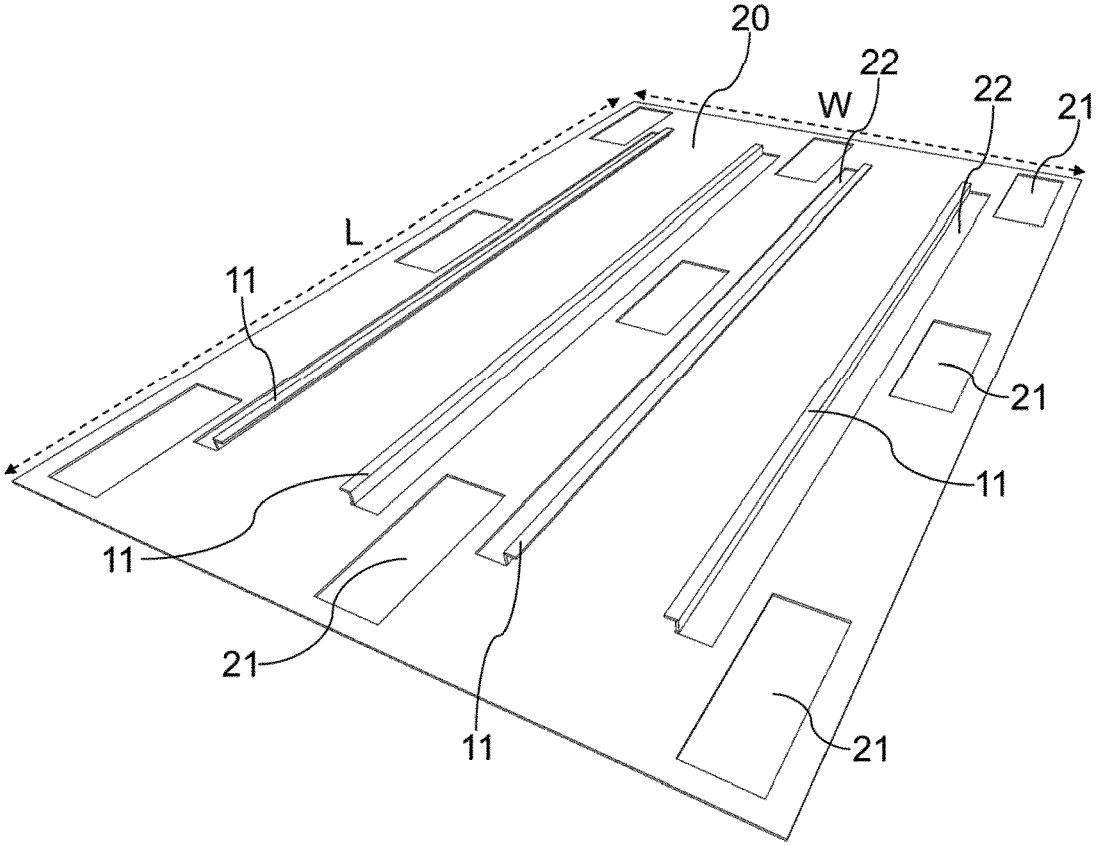
FIG. 16 shows a perspective top view of a second plate according to a third embodiment.

FIG. 16 shows a perspective top view of a second plate 20 according to a third embodiment, comprising fourth openings 22 at positions analogous to the fourth openings 22 of the second plate 20 according to the second embodiment (shown in FIG. 14).

Compared to the second embodiment shown in FIG. 14 only one supporting element 11 is positioned along each fourth opening 22, wherein the supporting elements 11 along the fourth openings 22 comprise a first strip 11*a*, which is connected to the second plate 20 and extends transversely to the second plate 20, and a second strip 11*b*, which is connected to the first strip 11*a*, and parallel to the second plate 20. Therein, the first strips 11*a* and second strips 11*b* form an L-shaped profile viewed in a cross-section along the plane formed by the width W and height H of the pallet 1 with a right angle between the first strip 11*a* and the second strip 11*b*.

Figure 17:
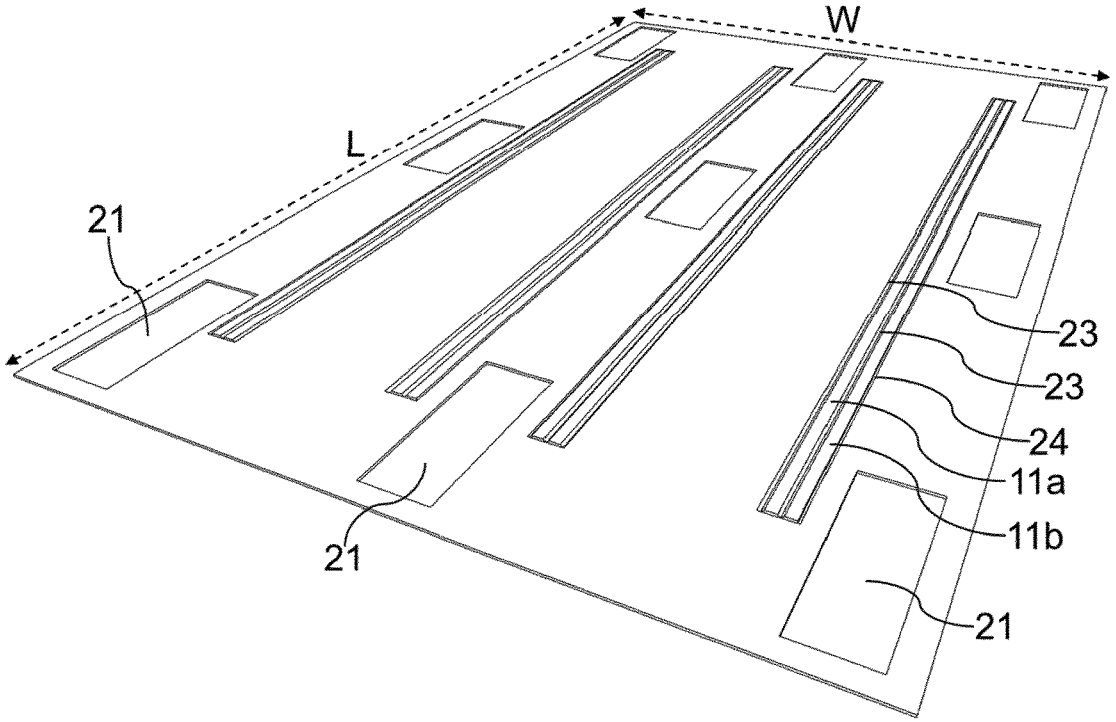
FIG. 17 shows a perspective top view of an intermediate product for forming the second plate according to the third embodiment.

FIG. 17 shows a perspective top view of an intermediate product for forming the second plate 20 according to the third embodiment. The intermediate product is composed of a plate, for example a high density fiber board, comprising third mitres 23, particularly V-shaped third mitres 23, cuts 24, and third openings 21.

In order to form the second plate 20 shown in FIG. 16, the supporting elements 11 are folded from the plate, wherein the respective third mitres 23 form the connection between the second plate 20 and the respective first strip 11*a*, and between the respective first strip 11*a* and the respective second strip 11*b*. The cut 24 serves to separate the formed supporting element 11 from the second plate 20 at one side of the respective fourth opening 22 formed by folding of the supporting element 11.

Figure 18:
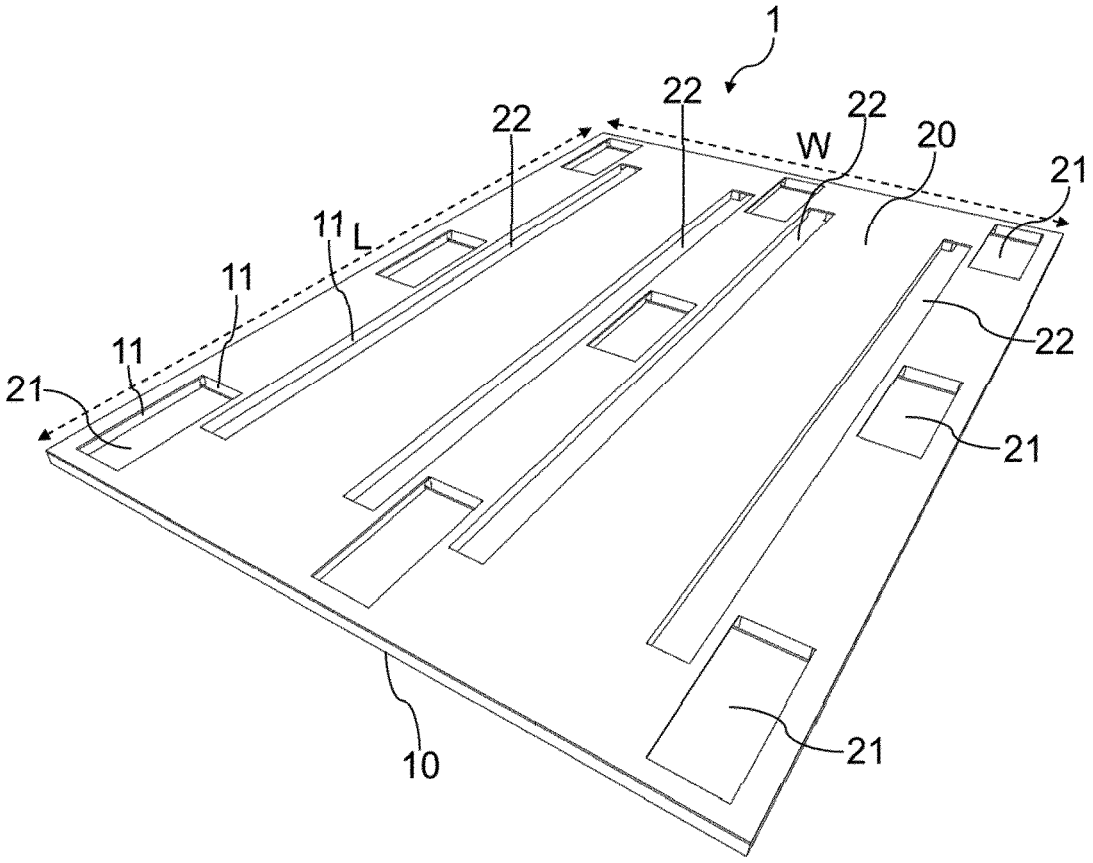
FIG. 18 shows a perspective top view of a pallet comprising a second plate according to the second or third embodiment.

FIG. 18 shows a perspective top view of a pallet 1 comprising a second plate 20 according to the second or third embodiment. The supporting elements 11 positioned along the fourth openings 22 of the second plate 20 are oriented such that they form a staggered arrangement with the supporting elements 11 of the first plate 10. That is, when the first plate 10 and the second plate 20 are joined to form the pallet 1, the respective supporting elements 11 contact a flat corresponding surface of the respective other plate, such that they can be mechanically connected with the respective other plate (first plate 10 or second plate 20).

Such a staggered arrangement advantageously further increases the stability of the pallet 1.

LIST OF REFERENCE SIGNS

1 Pallet
10 First plate
11 Supporting element
11*a* First strip
11*b* Second strip
12 First mitre
13 Rim
14 First opening
15 Second opening
20 Second plate
21 Third opening
22 Fourth opening
23 Third mitre
24 Cut
30 Pallet foot
31 Bearing element

32 Base
33 Second mitre
34 Cutting position
35 Board
L Length
W Width
H Height
$e_1$ First maximal extension
$e_2$ Second maximal extension
$e_3$ Minimal extension
l Longitudinal axis

The invention claimed is:

1. A pallet (1) comprising a first plate (10) and a second plate (20), wherein said first plate (10) and said second plate (20) are parallel, and wherein said first plate (10) and said second plate (20) each extend along a length (L) and a width (W) of said pallet (1), and wherein said pallet (1) comprises a height (H) which extends transversely to said length (L) and said width (W), characterized in that said first plate (10) and/or said second plate (20) comprises at least one supporting element (11) which is integrally formed with said first plate (10) or said second plate (20), wherein said at least one supporting element (11) extends between said first plate (10) and said second plate (20) along said height (H);

wherein said first plate (10) comprises at least one first opening (14), wherein said at least one supporting element (11) is positioned adjacent to said at least one first opening (14), wherein said first plate (10) and said at least one supporting element (11) are mechanically connected to each other by means of corresponding first mitres (12);

wherein said pallet (1) comprises at least one pallet foot (30), wherein said first plate (10) comprises at least one second opening (15), and wherein said at least one pallet foot (30) at least partially protrudes through said at least one second opening (15); and wherein said second plate (20) comprises at least one third opening (21), wherein said at least one third opening (21) at least partially overlaps with, particularly is aligned with, said at least one second opening (15) of said first plate (10).

2. The pallet (1) according to claim 1, characterized in that said first plate (10) and/or said second plate (20) are formed from a wood material, particularly a high density fiber board.

3. The pallet (1) according to claim 1, characterized in that said first plate (10) and said second plate (20) are mechanically connected by means of said at least one supporting element (11).

4. The pallet (1) according to claim 1, characterized in that said second plate (20) comprises at least one fourth opening (22), wherein said at least one supporting element (11) is positioned adjacent to said at least one fourth opening (22), wherein said second plate (20) and said at least one supporting element (11) are mechanically connected to each other by means of corresponding third mitres (23).

5. The pallet (1) according to claim 1, characterized in that said pallet (1) comprises at least one first supporting element (11) extending along said length (L) of said pallet (1) and at least one second supporting element (11) extending along said width (W) of said pallet (1).

6. The pallet (1) according to claim 4, characterized in that said at least one supporting element (11) comprises a first strip (11*a*) extending along said height (H) and a second strip (11*b*) which is parallel to said first plate (10) and said second plate (20), wherein said first strip (11*b*) is mechanically connected to said first plate (10) or said second plate (20) by means of a respective third mitre (23), and wherein said second strip (11*b*) is mechanically connected to said first strip (11*a*) by means of a further respective mitre (23).

7. The pallet (1) according to claim 1, characterized in that said at least one pallet foot (30) comprises at least two bearing elements (31) and a base (32), wherein said at least two bearing elements (31) are mechanically connected to each other by means of said base (32), and wherein said at least two bearing elements (31) at least partially protrude through said at least one second opening (15) of said first plate (10).

8. The pallet (1) according to claim 7, characterized in that said at least two bearing elements (31) are mechanically connected to respective supporting elements (11) positioned adjacent to said at least one second opening (15) through which said at least two bearing elements (31) at least partially protrude.

9. The pallet (1) according to claim 7, characterized in that said at least two bearing elements (31) and said base (32) are integrally formed by a board, particularly comprising wood material, wherein said board comprises second mitres (33) at the mechanical connections between said at least two bearing elements (31) and said base (32).

10. The pallet (1) according to claim 7, characterized in that said base (32) extends along a longitudinal axis (1) and has a trapezoid shaped cross-section transversely to said longitudinal axis (1), wherein particularly said base (32) is formed by a wood material, more particularly a medium density fibre board.

11. A method for manufacturing a pallet (1), particularly according to claim 1, wherein a first plate (10) and a second plate (20) are provided, and wherein at least one first mitre (12) is generated in said first plate (10) and/or at least one third mitre (23) is generated in said second plate (20), and wherein at least one supporting element (11) is generated by folding a segment of said first plate (10) at said at least one first mitre (12) or a segment of said second plate (20) at said at least one third mitre (23), such that said at least one supporting element (11) extends transversely to the surface of said first plate (10), and wherein the position of said at least one supporting element (11) is fixed, particularly by gluing, and wherein said second plate (20) is mechanically connected to said first plate (10) by means of said at least one supporting element (11).

12. The method according to claim 11, wherein at least one second opening (15) is generated in said first plate (10), and wherein at least one pallet foot (30) is attached to said pallet (1), wherein said at least one pallet foot (30) at least partially protrudes through said at least one second opening (15), and wherein at least one third opening (21) is generated in said second plate (20), wherein said at least one third opening (21) at least partially overlaps, particularly is aligned with said at least one second opening (15) in said first plate (10).

* * * * *